United States Patent [19]

Pokalsky

[11] Patent Number: 4,568,921

[45] Date of Patent: Feb. 4, 1986

[54] THEFT DETECTION APPARATUS AND TARGET AND METHOD OF MAKING SAME

[75] Inventor: Peter A. Pokalsky, East Meadow, N.Y.

[73] Assignee: Knogo Corporation, Hicksville, N.Y.

[21] Appl. No.: 630,708

[22] Filed: Jul. 13, 1984

[51] Int. Cl.[4] ..... G08B 13/24

[52] U.S. Cl. ..... 341/572; 340/551

[58] Field of Search ..... 340/551, 572

[56] References Cited

U.S. PATENT DOCUMENTS

| | | | |
|---|---|---|---|
| 3,534,243 | 10/1970 | Kondo et al. | 321/45 |
| 3,665,449 | 5/1972 | Elder et al. | 240/280 |
| 3,673,437 | 6/1972 | Wright | 307/252 |
| 3,737,735 | 6/1973 | Benassi | 317/148 |
| 3,747,086 | 7/1973 | Peterson | 340/280 |
| 3,765,007 | 10/1973 | Elder | 340/280 |
| 3,790,945 | 2/1974 | Fearon | 340/280 |
| 3,820,103 | 6/1974 | Fearon | 340/280 |
| 3,820,104 | 6/1974 | Fearon | 340/280 |
| 4,074,249 | 2/1978 | Minasy | 340/280 |
| 4,118,693 | 10/1978 | Novikoff | 340/572 |
| 4,326,198 | 4/1982 | Novikoff | 340/572 |

FOREIGN PATENT DOCUMENTS 763681 5/1934 France .

*Primary Examiner*—Glen R. Swann, III

*Attorney, Agent, or Firm*—Fitzpatrick, Cella, Harper & Scinto

[57] ABSTRACT

Items of merchandise (30) are protected from shoplifting or theft by affixing to them, special responder targets (32), which are formed by drawing a material of high magnetic permeability into a thin wire, then heat treating the wire to substantially increase its magnetic permeability and thereafter severing the wire into individual lengths. Several wires (32*a*, 32*b* and 32*c*) may be positioned on a common adhesively coated base strip (42) and covered by a peel strip (46) and wire like deactivation elements (48) of hard magnetic material may be positioned adjacent the wires for deactivating them.

29 Claims, 6 Drawing Figures

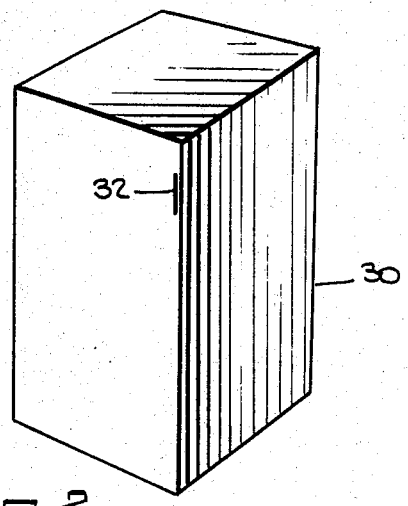
Fig. 2.
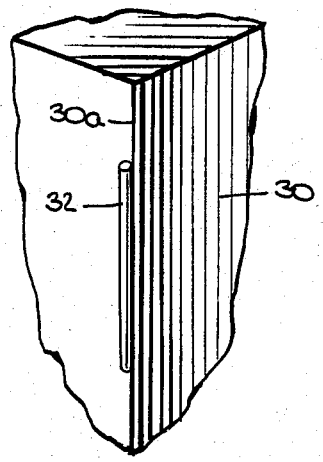
Fig. 3.
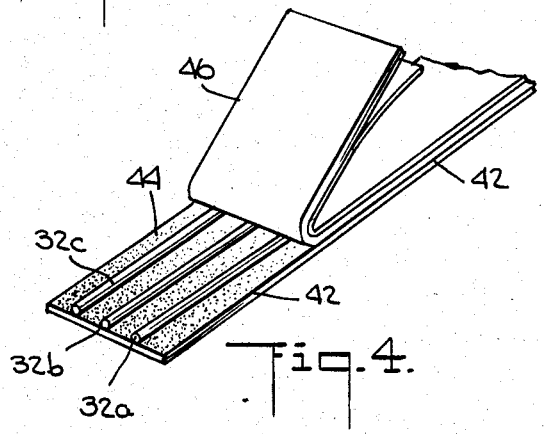
Fig. 4.
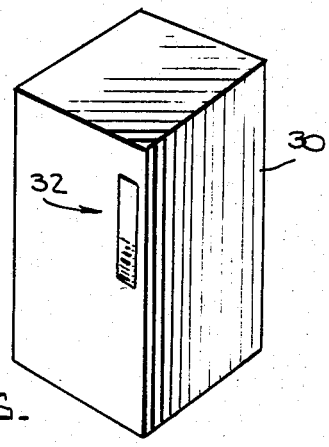
Fig. 5.
Fig. 6.
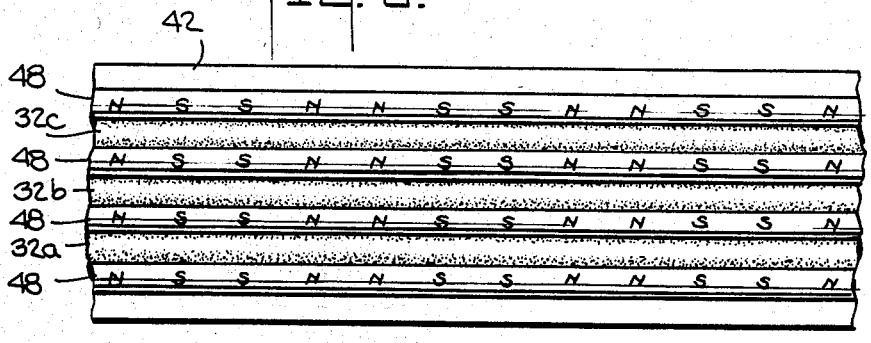

THEFT DETECTION APPARATUS AND TARGET AND METHOD OF MAKING SAME

BACKGROUND OF THE INVENTION

1. Field of the Invention

This invention relates to theft detection apparatus of the type in which a protected object is detected by monitoring the magnetic fields produced by responder targets on protected articles when such articles are carried through an interrogation zone in which an alternating magnetic field is generated. In particular the invention comprises improvements relating to the responder targets and their manufacture.

2. Description of the Prior Art

French Pat. No. 763,681 to Pierre Arthur Picard discloses an article theft detection apparatus of the type to which this invention applies. As described in that patent, articles to be protected from theft are provided with responder targets in the form of thin strips of material having a high magnetic permeability and which are rapidly and repeatedly driven into and out of magnetic saturation in the presence of an alternating magnetic interrogation field. An interrogation antenna is provided at an interrogation zone in a passageway leading to the exit of a store or a protected area in a store; and means are provided to cause the interrogation antenna to generate an alternating magnetic field at a given frequency and at an intensity sufficient to saturate a responder target in the interrogation zone. As a result, the responder target itself produces alternating magnetic fields at frequencies which are harmonics of the given transmitter frequency. A receiver antenna is also provided at the interrogation zone to receive the magnetic fields produced by the responder target. The receiver antenna is connected to a receiver which is tuned to detect signals at one or more of the harmonic frequencies produced by the responder target; and an alarm is connected to the receiver to be activated when such detection takes place.

Various refinements to the basic device shown in French Pat. No. 763,681 are shown and described in pending U.S. application Ser. No. 509,292 filed June 29, 1983 and U.S. Pat. Nos. 4,074,249, 4,118,693, 3,820,103, 3,820,104, 3,673,437, 3,737,735, 3,534,243 and 4,326,198.

The French Pat. No. 763,681 discloses that if the responder target is of elongated configuration, it will be saturated earlier, i.e. at a lower intensity of the interrogating magnetic field, than a short target or responder. U.S. Pat. No. 3,790,945 states that in the case of a responder target with dimensions providing a very high ratio of length to square root of cross-sectional area, the signal resulting from the presence of the very high harmonics is far greater than that resulting from greater amounts of the same materials having non-preferred dimensions. According to this last mentioned patent, the responder target (i.e., "marker") should have a high magnetic permeability (Permalloy metal is suggested); and it should be provided with a very slender cross-section as compared with length, as for example a cross-sectional area of 0.0004 square centimeters, and a length of 4 centimeters or more, this same being comprised in a ribbon not thicker than 0.00125 centimeters. This patent also states that the responder target is preferably provided with a ratio of length to square root of cross-sectional area which exceeds 200.

In the past, responder targets of Permalloy or similar material have been made by rolling the material to a very thin sheet, then heat treating the sheet to obtain the necessary magnetic properties and then slitting the sheet into strips of desired width. Usually the strips are laminated to paper or plastic ribbon as described in U.S. Pat. Nos. 3,820,103 and 4,074,249. Also, in cases where the responder targets are to be capable of being deactivated, a hard magnetic material of high coercive force (i.e. a semi-permanent magnet material) is laminated alongside the Permalloy strip, as described in U.S. Pat. Nos. 3,747,086 and 3,765,007.

While it is desirable to provide responder targets having a high ratio of length to square root of cross sectional area, there are certain practical problems which limit this ratio. Firstly, highly permeable, magnetically soft materials such as Permalloy do not have substantial structural strength; and when they are rolled into very thin sheets, e.g. about 0.00125 centimeters, they are difficult to handle. Secondly, the magnetic properties of these materials is adversely affected by strain. Accordingly when the thin rolled sheets are handled, they tend to stretch and their magnetic characteristics deteriorate. Also, when the sheets are slit into strips, the strain produced along their edges deteriorates their magnetic characteristics so that there is a limit to how narrow the strips may be cut. As a result of these practical problems, the responder strips of the prior art generally had a cross sectional area of about 0.0008 square centimeters and a length of about 7.6 centimeters. These targets were expensive from the standpoint of the cost of materials involved and they required complex and expensive machinery for rolling, slitting and assembly.

SUMMARY OF THE INVENTION

The present invention overcomes these problems of the prior art and makes possible a theft detection apparatus having responder targets which are smaller, more economical to manufacture and capable of providing a more distinct magnetic response than prior art responder targets.

According to one aspect of the invention there is provided a novel magnetic type electronic theft detection apparatus which comprises means for generating an alternating magnetic interrogation field in an interrogation zone, means for detecting magnetic response fields having predetermined characteristics in the zone and responder targets mounted on protected items which must be carried through the interrogation zone when taken from a protected area. The responder targets each comprise a length of drawn wire of an easily saturable magnetic material which has been heat treated, after drawing, to substantially increase its magnetic permeability.

In another aspect of the invention there is provided a novel responder target for use in a magnetic theft detection system of the type in which an alternating magnetic interrogation field is generated in an interrogation zone and magnetic response fields produced by a responder target passing through the interrogation zone are detected and, in response thereto, an alarm is actuated. This novel responder target comprises a length of drawn wire of easily satuarable magnetic material which has been heat treated after drawing, to substantially increase its magnetic permeability. The novel responder target, in one form, may be directly attached to items to be protected; and in another form it may be incorporated on a strip of paper or plastic and adhered, by the strip, to an item to be protected. In another form, the responder target may comprise an assembly of several lengths of drawn and heat treated wire arranged adjacent to one another. Further, there may be provided one or more elongated wire-like elements of a hard magnetic material adjacent to the responder target and magnetizeable with a pattern of spaced apart alternate north and south poles to deactivate the responder target.

According to a still further aspect of the invention there is provided a novel method for manufacturing a responder target for use in a magnetic type theft detection system. This method comprises the steps of drawing an easily saturable magnetic material into a wire, heat treating the drawn wire to substantially increase its magnetic permeability and cutting the wire into individual lengths.

By providing a responder target through the drawing of the target material into a wire and then heat treating the drawn wire, the responder target can be made to have an extremely small cross section which makes it economical to manufacture in that it does not require much material. Furthermore such a small cross section makes it easy to conceal the responder target on an item to be protected. Moreover the novel responder target of this invention produces a very distinct magnetic field disturbance which is easily detectable.

Additional advantages and features of the invention are described more fully hereinbelow.

BRIEF DESCRIPTION OF THE DRAWINGS

Preferred embodiments of the invention have been chosen for purposes of illustration and description and are shown in the accompanying drawings in which:

FIG. 2 is a perspective view of an article of merchandise with a special responder target according to the present invention;

FIG. 3 is an enlarged fragmentary view of a portion of the article of merchandise of FIG. 2 showing the responder target mounted thereon;

FIG. 4 is a perspective view showing an alternate responder target construction according to the present invention;

FIG. 5 is a perspective view of an article of merchandise provided with the alternate responder target construction of FIG. 4; and FIG. 6 is a plan view showing a still further alternate responder target construction according to the present invention.

DETAILED DESCRIPTION OF THE PREFERRED EMBODIMENTS

Figure 1:
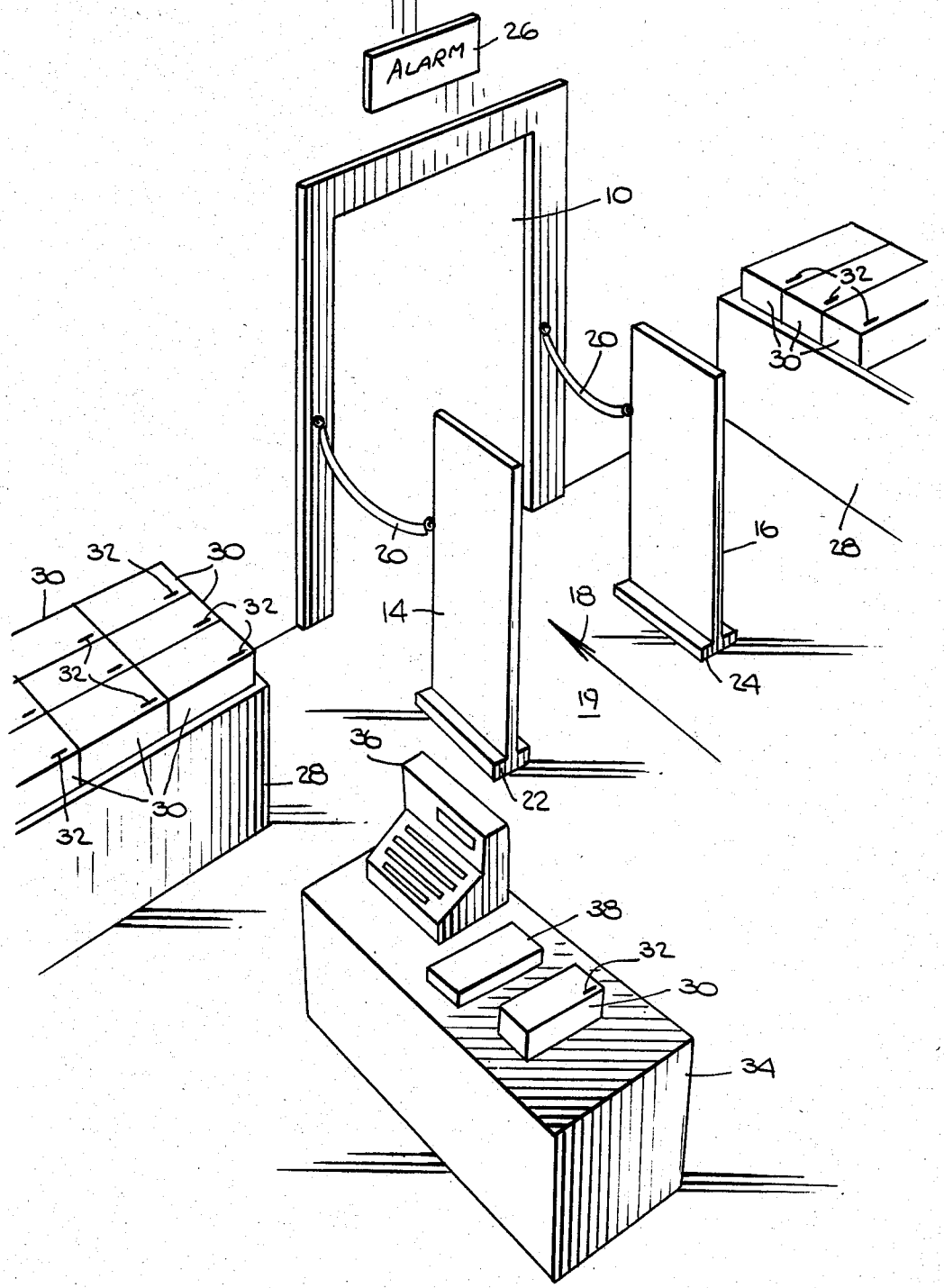
FIG. 1 is a perspective view of a store interior in which the present invention is used to prevent theft of merchandise.

As shown in FIG. 1 there is provided near a doorway 10 or other exit from a store or other protected region a pair of spaced apart antenna panels 14 and 16 arranged on opposite sides of a passageway (respresented by an arrow 18) through which patrons in the store must pass in order to exit via the doorway 10. Suitable structure, such as ropes 20 may extend from the antenna panels 14 and 16 to the doorway 10, if the panels are spaced from the doorway, in order to prevent patrons from bypassing the passageway 18. The portion of the passageway between the antenna panels 14 and 16 comprises an interrogation zone 19.

The antenna panels 14 and 16 contain interrogation and receiver antenna coils (not shown) and they are mounted on bases 22 and 24 which contain electrical components (also not shown) to which the antenna coils are connected. Some of these electrical components are connected to and cause the interrogation antenna coils to generate an alternating magnetic interrogation field in the interrogation zone 19. The other electrical components are connected to the receiver antenna coil and convert predetermined magnetic disturbances, caused by the presence of protected merchandise in the interrogation zone 19, to produce an alarm signal. The alarm signal is suitably transmitted to an alarm, such as a lighted sign 26 above the doorway, to actuate the alarm and signal the unauthorized taking of protected merchandise from the store. An acoustical alarm may also be provided to be actuated concurrently with the visual alarm sign 26.

The particular construction and arrangement of the interrogation and receiver antenna coils and of the electrical components is not a part of this invention and will not be described herein. Reference is made however to the various patents and patent applications identified above which show and describe in detail suitable apparatus for this purpose.

Within the store there are provided display cases 28 which contain items of merchandise 30 for inspection and purchase by customers in the store. The items 30 are provided with special responder targets 32 which, in their active state, interact with the alternating magnetic fields in the interrogation zone 19 to produce the predetermined magnetic disturbances which cause the alarm signal to be generated.

There is also provided in the store 10 a purchase and authorization counter 34 to which items of merchandise to be purchased are taken. At the purchase or authorization counter there is usually provided a cash register 36. There also may be provided a deactivation mechanism 38 for rendering the target 32 on a purchased item 30 incapable of producing the above mentioned predetermined disturbance of the interrogating magnetic field in the interrogation zone 19. Thus, which the item 30 is purchased, and its target 32 is deactivated, the item may be carried through the passageway 18 and out through the doorway 10 without activating the alarm 26.

In an alternative arrangement the target 32 is not deactivated but instead the purchased merchandise is bypassed by an authorized person around the interrogation zone 19 and then given to the patron who takes it out of the store.

FIG. 2 shows an enlargement of an item of merchandise 30 with one form of the special responder target 32 mounted on it. As can be seen, the special responder target 32 is in the form of a thin wire. Actually the wire is only about 0.005 inches (0.0127 centimeters) in diameter; and it has a length of about three inches (7.62 centimeters). As shown in the further enlargement of FIG. 3, the wire responder target 32 is preferably positioned so that extends along an edge or corner 30*a* of the merchandise 30. In this arrangement the responder target 32 can be mounted directly on the merchandise or on its package by glue or other adhesive or by other suitable means. For example, depending on the merchandise or its packaging the responder target 32 can be inserted between the layers or a seam of the merchandise or its package and thereby held in place without any adhesive. In any event, because of its extreme thinness, the responder target 32 is easily mounted and is easily concealed on the merchandise. Even when it is located on the outside of the merchandise or the package for the merchandise the responder target 32 cannot easily be seen, particularly when it is mounted to extend along a corner, as shown in FIG. 3.

The responder target 32 is manufactured according to the following steps. First, a highly magnetically permeable iron base alloy (e.g. Permalloy), containing about 45–80% nickel, is drawn, using conventional wire drawing techniques, into a continuous fine wire of from 0.005 to 0.009 inches (0.0127 to 0.0229 centimeters) in diameter. Following this drawing operation, the wire is heat treated to substantially increase its magnetic permeability; and then it is separated into individual lengths of about three inches (7.62 centimeters).

When the drawn wire is thus heat treated, its magnetic properties are modified in such a manner that its magnetic permeability is substantially increased. As a result, when the heat treated drawn wire is placed in an alternating magnetic field and driven into and out of saturation by the field the wire itself produced a very distinct magnetic signal in the form of a train of pulses having frequency components which are very high harmonics of the frequency of the alternating magnetic field.

The heat treating step is carried out by first heating the drawn wire to a temperature of about 600° C., maintaining the heated wire at that temperature for from one to four hours, then slowly reducing its temperature at a rate of about one half to one degree centigrade per minute until it reaches its Curie tempterature (about 300° C.); and then rapidly cooling it down to room temperature. Preferably the heat treatment is carried out in a hydrogen atmosphere. The wire may be maintained on a reel or a spool during the heat treating operation.

In addition to the fact that the thin responder targets 32 can be easily mounted and easily concealed on the merchandise 30, the wire-like target material, because of its axially symmetric cross section, is more easily handled than the flat strip material used in the past to form responder targets for magnetic type theft detection systems. That is, the target material of this invention is less susceptible to twisting then the prior art flat strip material.

In addition, it is possible with the present invention to provide a much higher aspect ratio i.e. ratio of length to square root of cross section than was possible in the prior art. The flat strips used for targets in the past were usually made from Permalloy material which was first rolled to a thickness of about 0.0005 inches (0.00127 centimeters), then heat treated and finally sliced into strips. The minimum width of these strips was about 0.0625 inches (0.159 centimeters). If the strips were made any narrower they could not be handled easily and, moreover, they were subject to strains which adversely affected their magnetic characteristics. Thus, the minimum cross sectional area of prior art target strips was 0.0000312 square inches (0.0002 square centimeters). The drawn wire responder targets 32 of the present invention, on the other hand, can easily be drawn down to a diameter of 0.005 inches (0.0127 centimeters) to provide a cross section of only 0.0000196 square inches (0.000127 square centimeters). Thus, for responder targets having a length of three inches (7.62 centimeters), the ratio of length to square root of cross section for 0.005 inch (0.0127 centimeter) diameter responder targets of the present invention may be 676, whereas the ratio of length to square root of cross section for the above described responder targets of the prior art is only 540.

By providing a higher aspect ratio (i.e. ratio of length to square root of cross section) than the prior art, the targets of the present invention become magnetically saturated at a lower field strength then those of the prior art and thus provide a more distinctive signal which can be easily detected by suitable signal processing and amplification. In addition, it has been found that when a responder target is made by drawing it as a wire, and then heat treating it, the resulting magnetic characteristics of the responder target are remarkably improved over the prior art. More specifically, it has been found that the drawn wire responder target produces a more sharply defined disturbance of the interrogation field then the prior art responder targets; and, because of this, the resulting electrical signals, even though smaller than those produced by prior art responder targets, can be easily detected by appropriate signal processing techniques.

While the preferred diameter of the responder target of the present invention is 0.005 inches (0.0127 centimeters), the responder target may have a diameter of about 0.009 inches (0.0229 centimeters). Smaller diameters may also be employed, provided that special care is taken to avoid subjecting the responder target material to mechanical strain which would alter its magnetic properties.

It has also been found that the signal amplitude produced by the responder target 32 can be greatly increased when several responder targets are placed adjacent each other on the protected merchandise. Such a multiple responder target assembly is shown in FIG. 4. As shown, the responder target assembly comprises a base strip 42 in the form of a web or ribbon of paper or plastic. The under side of the base strip 42, which is not shown in FIG. 4, may be printed with labeling information such as a commercial bar code. The upper surface of the strip 42 is provided with an adhesive coating 44; and a plurality of responder targets **32*a*, 32*b* and 32*c*, in the form of drawn and and heat treated Permalloy wire, are arranged parallel to each other and are adhered to the coating 44 on the strip. Although the responder targets 32*a*, 32*b* and 32*c*** are shown spaced apart from each other, they also may be positioned adjacent to each other.

A peel strip 46 is provided to cover the adhesive coating 44 of the base strip 42 as well as the responder targets **32*a*, 32*b* and 32*c*. The peel strip 46 has a release coating thereon which allows it to be peeled away, thus exposing the adhesive coating 44 and allowing the responder target assembly to be adhered to an item of merchandise 30 as shown in FIG. 5**.

The responder target assembly may be constructed, as shown in FIG. 6, so as to be deactivatable. For this purpose there are provided on each side of the responder targets **32*a*, 32*b* and 32*c*, a deactivation element 48 comprising a wire or strip of magnetically hard material which can be semi-permanently magnetized and demagnetized in different regions thereof by the application of external magnetic fields. Suitable magnetically hard material for this purpose is sold under the Registered Trademarks Vicalloy and Crovac. The deactivation elements are held to the base strip 42 by the adhesion coating 44; and a peel strip 46 (not shown) is provided to cover the base strip 42, the responder targets 32*a*, 33*b* and 32*c* as well as the deactivation elements 48** until the responder target assembly is to be applied to an item to be protected.

When the deactivation elements 48 are not magnetized, or when they have uniform magnetization along their length, the responder targets 32*a*, 32*b* and 32*c* operate as previously described to produce predetermined disturbances of the magnetic interrogation field in the interrogation zone 19 (FIG. 1). However, when the deactivation elements are magnetized such that they form a pattern of spaced apart alternate north and south magnetic poles, as shown in FIG. 6, the magnetic fields from those poles saturate the responder targets 32*a*, 32*b* and 32*c*, at spaced apart intervals along their length and render them incapable of disturbing the magnetic interrogation field. The deactivation elements 48 are provided with this special pattern of magnetization by means of the deactivation mechanism 38 at the purchase or authorization counter 34 (FIG. 1). The deactivation mechanism 38 contains a strip of material which is permanently magnetized according to a pattern such that along the strip there are provided spaced apart alternate north and south magnetic poles. The mechanism is also constructed so that the strip and the responder target assembly 40 are maintained parallel to each other while they are moved together and away from each other along a path perpendicular to this length. A more detailed description of a deactivation mechanism which operates in this manner is given in U.S. patent application entitled Method and Apparatus for Target Deactivation and Reactivation Ser. No. 513,242 filed July 13, 1983 in the names of Michael N. Cooper and Peter A. Pokalsky.

While the deactivatable responder target assembly of FIG. 6 uses three responder targets 32*a*, 32*b* and 32*c* and four deactivation elements 48, any number of responder targets and deactivation elements may be used, provided the magnetic fields provided by the deactivation elements are capable, when magnetized, of rendering the responder target or responder targets incapable of causing detectable predetermined disturbances of the magnetic interrogation field in the passageway 18.

The responder targets of the present invention are especially suited to mass production. As indicated above, the wire from which the responder targets 32 are formed may be drawn as a continuous filament and heat treated in that manner to attain the desired magnetic permeability. The continuous wire filament then may be severed into any desired lengths for use as responder targets. Since the severing at the ends of the elongated targets subjects them to minimal mechanical strain, their magnetic properties are not appreciably affected. In addition, where the continuous drawn and heat treated wire is to be used for multiple wire responder target assemblies, several spools of the wire can be fed simultaneously in side by side relationship onto the base strip 42, which itself may be a continuous web or ribbon. Likewise, where the responder target assembly is to be deactivatable continuous wires of hard magnetic material may simultaneously be bed onto the base strip 42. After the base strip, wire and peel strip assembly is completed, it may be wound onto a spool for later severing into responder targets of any desired length.

It will be appreciated from the foregoing that the responder targets of the present invention are more easily and economically manufactured, are more easily concealed on protected articles and produce more easily detected signals than responder targets of the prior art.

I claim:

1. A magnetic type electronic theft detection apparatus comprising means for generating an alternating magnetic interrogation field in an interrogation zone, means for detecting magnetic response fields having predetermined characteristics in said interrogation zone and responder targets mounted on protected items which must be carried through said interrogation zone when taken from a protected area, said responder targets each comprising a length of drawn wire of an easily saturable magnetic material, heat treated, after drawing, to substantially increase its magnetic permeability.

2. A magnetic type electronic theft detection apparatus according to claim 1 wherein said wire is drawn from an iron base alloy containing 45–80% nickel.

3. A magnetic type electronic theft detection apparatus according to claim 1 wherein said wire is drawn to a diameter of less than about 0.009 inches (0.023 centimeters).

4. A magnetic type electronic theft detection apparatus according to claim 1 wherein said wire is drawn to a diameter of about 0.005 inches (0.013 centimeters).

5. A magnetic type electronic theft detection apparatus according to claim 1 wherein at least one wire of a hard magnetic material, capable of being semi-permanently magnetized with spaced apart alternate north and south magnetic poles along its length, is positioned adjacent a responder target.

6. A magnetic type electronic theft detection apparatus according to claim 1 wherein at least one of said responder targets is mounted along a corner of a protected item.

7. A magnetic type electronic theft detection apparatus according to claim 1 wherein said responder targets are secured to said protected items by an adhesive.

8. A magnetic type electronic theft detection apparatus according to claim 1 wherein said responder targets are fitted into openings in said protected items.

9. A magnetic type electronic theft detection apparatus according to claim 1 wherein said responder target is an assembly of drawn wires of an easily saturable magnetic material, heat treated, after drawing, to substantially increase their magnetic permeability, said wires being positioned close to each other.

10. A magnetic type electronic theft detection apparatus according to claim 1 wherein said wires are placed parallel to each other on a base strip.

11. A magnetic type electronic theft detection apparatus according to claim 1 wherein said wires are held by adhesive to said base strip and in turn are held by said base strip onto a protected item.

12. A magnetic type electronic theft detection apparatus according to claim 1 wherein a plurality of wires of a hard magnetic material, capable of being semi-permanently magnetized with spaced apart alternate north and south magnetic poles along their length, extend alongside and are interspersed among said drawn and heat treated wires.

13. A responder target for use in a magnetic theft detection system of the type in which an alternating magnetic interrogation field is generated in an interrogation zone and magnetic response fields produced by a responder target passing through said interrogation zone are detected and, in response thereto, an alarm is actuated, said responder target comprising a drawn wire of easily saturable magnetic material, said wire being heat treated after drawing to substantially increase its magnetic permeability.

14. A responder target according to claim 13 wherein said wire is drawn from an iron base alloy containing 45–80% nickel.

15. A responder target according to claim 13 wherein said wire is drawn to a diameter of less than about 0.009 inches (0.023 centimeters).

16. A responder target according to claim 13 wherein said wire is drawn to a diameter of about 0.005 inches (0.013 centimeters).

17. A responder target according to claim 13 wherein at least one wire of a hard magnetic material, capable of being semi-permanently magnetized with spaced apart alternate north and south magnetic poles along its length, is positioned adjacent said wire.

18. A responder target according to claim 13 wherein said responder target is an assembly of drawn wires of an easily saturable magentic material, heat treated, after drawing, to substantialy increase their magnetic permeability, said wires being positioned close to each other.

19. A responder target according to claim 18 wherein said wires are placed parallel to each other on a base strip.

20. A responder target according to claim 19 wherein said wires are held by adhesive to said base strip and in turn are held by said base strip onto a protected item.

21. A responder target according to claim 18 wherein a plurality of wires of a hard magnetic material, capable of being semi-permanently magnetized with spaced apart alternate north and south magnetic poles along their length, extend alongside and are interspersed among said drawn and heat treated wires.

22. A method of manufacturing a responder target for use in a magnetic theft detection system of the type in which an alternating magnetic interrogation field is generated in an interrogation zone and magnetic response fields produced by a target passing through said interrogation zone are detected, and in response thereto an alarm is actuated, said method comprising the steps of drawing an easily saturable magnetic material into a wire, heat treating the drawn wire to substantially increase its magnetic permeability and cutting the wire into individual lengths.

23. A method according to claim 22 wherein said wire is drawn from an iron base alloy containing 45–80% nickel.

24. A method according to claim 22 wherein said wire is drawn to a diameter of less than about 0.009 inches (0.023 centimeters).

25. A method according to claim 22 wherein said wire is drawn to a diameter of about 0.005 inches (0.013 centimeters).

26. A method according to claim 22 wherein said wire is heat treated prior to cutting the wire into individual lengths.

27. A method according to claim 22 wherein a plurality of said wires are placed adjacent to each other on an item to be protected.

28. A method according to claim 22 wherein said plurality of wires are positioned on a base strip having an adhesive coating, and the base strip together with the wires is severed into predetermined lengths and affixed to items to be protected.

29. A method according to claim 22 wherein the wires are each positioned adjacent a wire of a magnetically hard substance capable of being semi-permanently magnetized along its length.

* * * * *

UNITED STATES PATENT AND TRADEMARK OFFICE

CERTIFICATE OF CORRECTION

PATENT NO. : 4,568,921

DATED : February 4, 1986

INVENTOR(S) : PETER A. POKALSKY

It is certified that error appears in the above-identified patent and that said Letters Patent is hereby corrected as shown below:

Title Page, [54] "THEFT DETECTION APPARATUS AND TARGET AND METHOD OF MAKING SAME" to read -- MAGNETIC THEFT DETECTION APPARATUS AND DRAWN WIRE TARGET AND METHOD OF MAKING SAME --;

Column 1, line 2, "THEFT DETECTION APPARATUS AND TARGET AND METHOD OF MAKING SAME" to read -- MAGNETIC THEFT DETECTION APPARATUS AND DRAWN WIRE TARGET AND METHOD OF MAKING SAME --.

Signed and Sealed this

*Twenty-seventh* Day of *May 1986*

[SEAL]

*Attest:*

DONALD J. QUIGG

*Attesting Officer*

*Commissioner of Patents and Trademarks*